US005878906A

United States Patent [19]

Bolton et al.

[11] Patent Number: 5,878,906

[45] Date of Patent: Mar. 9, 1999

[54] VENTABLE CONTAINER

[75] Inventors: Stewart Lawrence Bolton, deceased, late of Springfield, N.J., by Irene B. Bolton, executrix; Michael Edward Delonis, Wappingers Falls, N.Y.; William Charles Wysong, Port Orange, Fla.

[73] Assignee: Kraft Foods, Inc., Northfield, Ill.

[21] Appl. No.: 824,674

[22] Filed: Mar. 26, 1997

[51] Int. Cl.[6] ..... B65D 41/02

[52] U.S. Cl. ..... 220/309.1; 220/277; 220/619

[58] Field of Search ..... 220/309.1, 310.1, 220/265, 277, 276, 614, 618, 623, 634, 619, 620

[56] References Cited

U.S. PATENT DOCUMENTS

| | | | |
|---|---|---|---|
| 1,369,001 | 2/1921 | Bentley | 220/310.1 |
| 1,370,134 | 3/1921 | Ledwinka | 220/310.1 |
| 1,431,218 | 10/1922 | Cooke | 220/310.1 |
| 2,296,430 | 9/1942 | Erb | 220/277 |
| 2,318,603 | 5/1943 | Erb | 220/277 |
| 2,346,165 | 4/1944 | Hothersall | 220/277 |
| 2,523,285 | 9/1950 | Erb | 220/277 |
| 3,186,583 | 6/1965 | Zundel | 220/277 |
| 3,240,383 | 3/1966 | Scholtz | 220/44 |
| 3,905,513 | 9/1975 | Klein | 220/265 |
| 5,344,662 | 9/1994 | Payne et al. | 426/124 |
| 5,445,291 | 8/1995 | Daniel | 220/366.1 |

FOREIGN PATENT DOCUMENTS 1309992 11/1992 Canada .

*Primary Examiner*—Stephen Castellano
*Attorney, Agent, or Firm*—Thomas A. Marcoux; Thomas R. Savoie

[57] ABSTRACT

A container for holding contents such as particulate material under pressure. A lid of the container has a bend that operatively engages the inside sidewall of the container, preferably a bead located in said sidewall to form a restricted passage therebetween. The restricted passage enables venting of the pressurized gas within the container while substantially retaining the particulate product. The restricted passage can additionally have a spray control material located therein.

11 Claims, 2 Drawing Sheets

VENTABLE CONTAINER

FIELD OF THE INVENTION

The present invention relates to a container, and more particularly, to a container which maintains a particulate product under pressure and which permits venting of the pressurized gas when initially opening the container.

BACKGROUND OF THE INVENTION

Particulate product such as roast and ground coffee is conventionally packaged in a vacuum or under pressure. If the roast and ground coffee is packed under pressure, upon initial opening of the container, there is a rush of gas from the interior of the container to the exterior thereof, which rush, if unobstructed, would carry the particulate product with it, thereby causing a mess in the vicinity surrounding the newly opened container. However, if one properly controls the opening structure, this rush of gas can become an advantage by allowing a pleasurable burst of coffee aroma, while restraining the particulate product itself.

Roast and ground coffee is now typically packaged in a cylindrical plated steel can container having a conventional sealed top closure which is openable by puncturing with a can opener or other tool. However, in such closure structures, the size of the opening, the timing of effecting the opening and the gas flow speed are essentially unpredictable, thus allowing no control whatsoever over the flow rate of the initial gas burst and/or retention of the particulate product.

Known conventional plated steel can containers which package roast and ground coffee under pressure generally have some arrangement for controlling the outward flow of the gas burst so as to allow venting of gas while restraining the outward movement of the particulate roast and ground coffee. One such arrangement is shown in the Scholtz U.S. Pat. No. 3,240,383, and another is shown in the Daniel U.S. Pat. No. 5,445,291. Generally, these prior arrangements have the disadvantage of being somewhat complex.

Accordingly, there remains a need for a new and improved container containing particulate product packaged under pressure, which allows for venting of the pressurized gas within the container upon initial opening thereof while substantially retaining the particulate product.

SUMMARY OF THE INVENTION

Thus, it is a purpose of the present invention to provide a new and improved container for particulate product such as roast and ground coffee packaged under pressurized conditions, e.g., up to 15 psi, which is relatively simplified and hence advantageous relative to prior arrangements.

A preferred arrangement comprises a container having a shaped lid and shaped sidewall which operatively engage each other to form a restricted passage which allows a controlled gas flow while substantially inhibiting the spraying of the particulate product upon initial opening of the container. The lid preferably has an "S" or "Z" shaped bend which operatively engages the interior of the sidewall of the container to form the restricted passage. Preferably, the bend engages an indented (interiorly raised) bead in the sidewall to form the operative engagement therewith.

In one preferred embodiment, the lid has a "Z" shaped bend which preferably directly engages the sidewall.

In another embodiment, the lid has an "S" shaped bend, and a spray control material is interposed between the bend and the sidewall.

Of course variations are possible, for example the "S" shaped bend embodiment may exclude the spray control material and/or the "Z" bend may include a spray control material.

It is therefore an object of the invention to provide a container in which particulate roast and ground coffee is packaged under pressure, which container when opened by a conventional can opener, other tool or the like substantially retains the particulate product in the container while allowing for venting of the pressurized gas. This advantageously allows higher line speeds, lower can plate weights, and lower costs.

These and other objects of the present invention will become apparent from the detailed description to follow.

BRIEF DESCRIPTION OF THE DRAWINGS

There follows a detailed description of preferred embodiments of the present invention which are to be taken together with the accompanying drawings, wherein.

DESCRIPTION OF THE PREFERRED EMBODIMENTS

Referring now to the figures, like elements are represented by like numerals throughout the several views.

Figure 1:
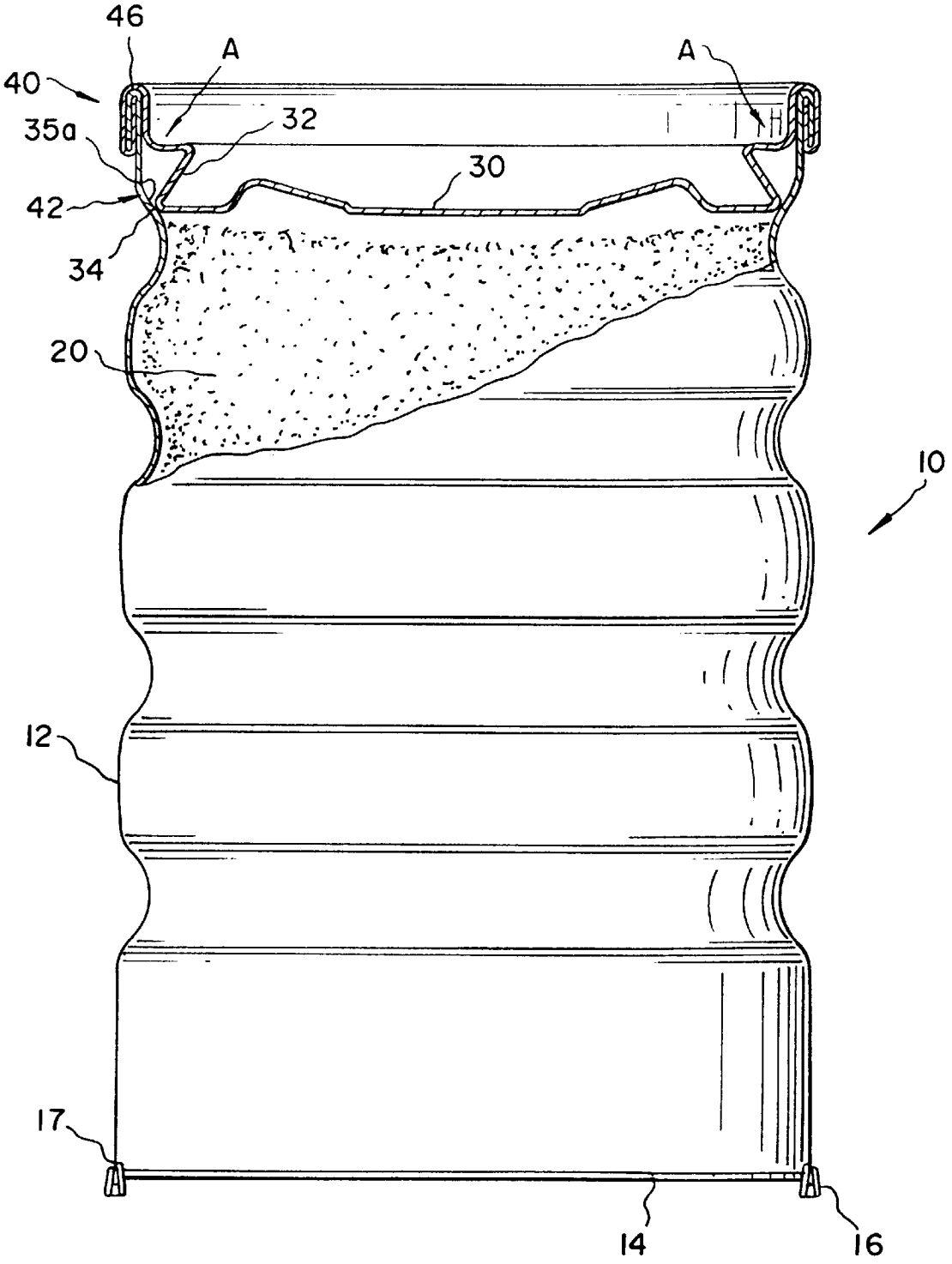
FIG. 1 is a partial cross-sectional front elevational view of a container employing the invention.

FIG. 1 shows an embodiment of the invention wherein a container 10 containing a particulate product 20 such as roast and ground coffee packaged under pressure comprises a sidewall 12 and a bottom 14. The bottom 14 is attached and sealed to the sidewall through a bottom lip connection 16 which is shown here as a bend in the bottom 14 pinched onto a bottom end 17 of the sidewall 12.

The top of the container is sealed by a lid 30 which is attached to sidewall 12 at lid connection 40. In connection 40, a sealing compound 46 may be included for more securely sustaining the pressure within the enclosed container beyond that which is achieved simply by pressing together the lid 30 and sidewall 12 to achieve a contact-fit seal. Lid 30 has a "Z" shaped curve 32 extending completely 360° around the lid such that its bottom outer bend 34 operatively engages the interior sidewall 12 for 360° around the interior of the can forming a restricted passage 42 therebetween which will allow pressurized gas to flow therethrough while restricting the flow of particulate product. Preferably, the sidewall 12 has a bead 35 towards the top edge of the sidewall which forms the engagement with the bend 34 with the bend 34 engaging the interior upper slope 35*a* of bead 35. In a preferred embodiment, bead 34 would have a radius of curvature of about 0.018 inches.

When the closed pressurized container 10 is initially opened by puncturing the lid 30 in the conventional manner in vicinity A, such as by a conventional can opener, restricted passage 42 allows the pressure to be released, but retains the particulate product within the container 10.

Figure 2:
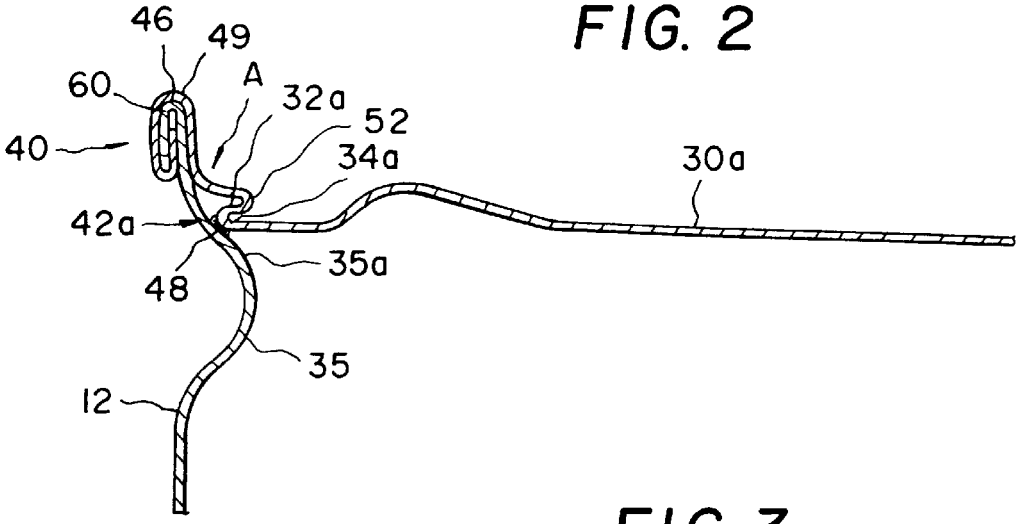
FIG. 2 is a enlarged, fragmentary, cross-sectional view of the connection between the sidewall and top, showing another embodiment of the invention.
Figure 4:
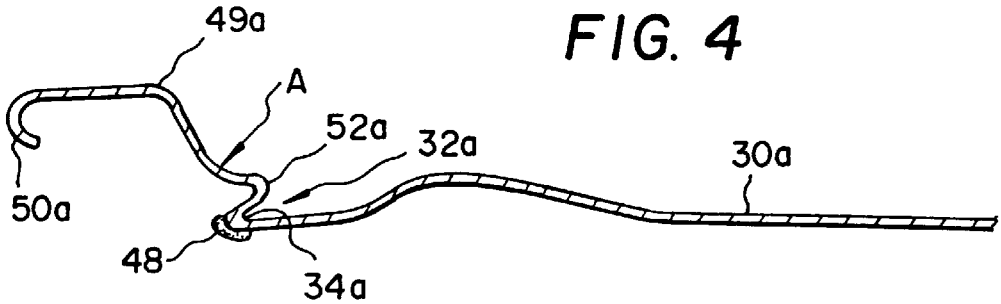
FIG. 4 is a fragmentary, cross-sectional view of the top used to form the embodiment of the invention shown in FIG. 2.

In another embodiment, as shown in FIGS. 2 and 4, the lid 30*a* has an "S" shaped curve with the vicinity A on a slight inward down slope with the rounded bead 52*a* bent back towards the lower bend 34*a* which forms the restricted passage 42*a* with the sidewall 12. The bend 34*a* preferably has a radius of curvature of approximately 0.018 inches. In this embodiment, a spray control material 48 may be disposed on the bend 34*a* at the operative engagement between the lid 30*a* and the sidewall 12. The spray control material may comprise a porous material such as filter paper which may be woven or non-woven, with natural or artificial fibers or a blend, a polypropyene foam material or rubber-based can end compound.

Figure 3:
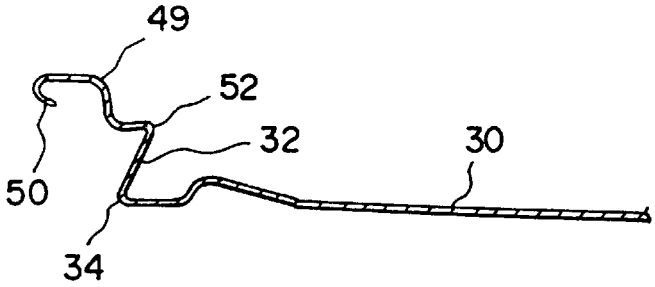
FIG. 3 is a fragmentary, cross-sectional view of the top used to form the embodiment of the invention shown in FIG. 1.
Figure 5:
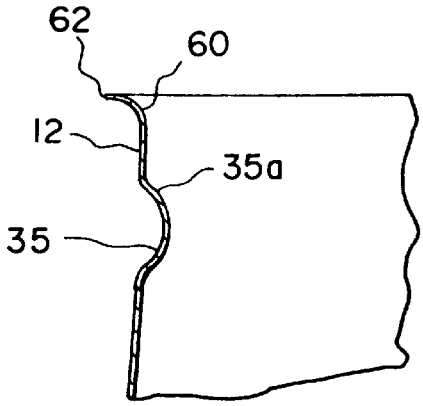
FIG. 5 is a fragmentary cross-sectional view of the sidewall used to form the invention.

FIGS. 3 and 4 show the initial form of lids 30 and 30*a* and FIG. 5 shows the initial form of sidewall 12 prior to forming the sealed container. Prior to forming the container, each lid 30 and 30*a* has a corner 49,49*a* in the form of a substantially right angle as shown in FIGS. 3 and 4, as compared with the substantially "U-shape" as shown in FIGS. 1 and 2. Similarly, corner 60 of sidewall 12 has a substantially right angle shape as shown in FIG. 5 as compared to the substantially U-shaped it takes after sealing lid 30 or 30*a* to the sidewall 12. Therefore, in order to form a container 10 having a restricted passage 42, 42*a*, a substantially flat circular lid is bent so as to form a lid hook 50,50*a* around the circumferential edge. A substantially right angular corner 49,49*a* is formed adjacent to the lid hook 50,50*a*. Referring to FIG. 3, the "Z" shaped curve 32 is formed so as to have a bottom bend 34 of the "Z" located radially inward from the top bend 52 thereof. Similarly, the "S" shaped curve 32*a* of FIGS. 2 and 4 is formed so as to have a bottom bend 34*a* of the "S" located radially inward from the top bend 52*a* thereof.

In order to form the corresponding sidewall hook 60, as shown in FIG. 5, a substantially cylindrical sidewall 12 must be outwardly bent at a top lip 62 so as to form the substantially right angle or sidewall hook 60. In order to mate the lid 30,30*a* with the sidewall 12, lid hook 50,50*a* is placed over top lip 62 of sidewall 12 and then corner 49 is bent from a 90° angle to a substantially U-shape. This effectively pinches or bends the lid hook 50 and sidewall hook 60 together to form the seal. In order to form a container 10 having sealing means 46, the appropriate sealing compound must be disposed on one or both of the appropriate surfaces of either sidewall 60 or corner 49.

Although the invention has been described with respect to preferred embodiments, it will be apparent that numerous variations and modifications are possible, within the scope of the appended claims.

What is claimed is:

1. A container for a particulate product packaged under pressure comprising:

a sidewall having a top edge;

a bottom connected to a lower edge of said sidewall to form a container with an open top end for receiving a particulate product therein; and a lid connected to the top edge and covering said open top to form a sealed, airtight container, said lid including a wall extending inside said container and operatively engaging an interior of said sidewall such that the interior of said sidewall and said wall of said lid form a restricted passage for 360° around the interior of the container having means for venting gases therethrough when the lid is punctured to diffuse the pressure differential between the outside and inside of the container while minimizing movement of particulate product through said restricted passage.

2. A container as claimed in claim 1, wherein said lid has a "Z" shaped bend extending for essentially 360° around the lid, the lower bend of the "Z" forming said operative engagement with the sidewall.

3. A container as claimed in claim 2, wherein the operative engagement between the lower bend of the "Z" and the sidewall is formed on an inwardly indented bead of the sidewall.

4. A container as claimed in claim 3, wherein the lower bend of the "Z" engages the upper sloped portion of the bead of the sidewall.

5. A container as claimed in claim 1, wherein the restricted passage further comprises a spray control material located at said operative engagement between the lid and the interior wall of the sidewall.

6. A container as claimed in claim 5, wherein said spray control material is selected from the group consisting of woven or non-woven filter paper with natural or artificial fibers or a blend, polypropylene foam material and rubber-based can end compound.

7. A container as claimed in claim 1, wherein the lid has a "S" shaped curve extending for essentially 360° around the lid, the lower bend of the "S" forming said operative engagement with the sidewall.

8. A container as claimed in claim 7, wherein the restricted passage further comprises a spray control material located at said operative engagement between the lid and the interior wall of the sidewall.

9. A container a claimed in claim 8, wherein said spray control material is selected from the group consisting of woven or non-woven filter paper with natural or artificial fibers or a blend, polypropylene foam material and rubber-based can end compound.

10. A container as claimed in claim 7, wherein the operative engagement between the lower bend of the "S" and the sidewall is formed on an inwardly indented bead of the sidewall.

11. A container as claimed in claim 10, wherein the lower bend of the "S" engages the upper sloped portion of the bead of the sidewall.

* * * * *